US005954320A

United States Patent [19]

Bohler

[11] Patent Number: 5,954,320

[45] Date of Patent: Sep. 21, 1999

[54] CLAMPING DEVICE FOR A MACHINE TOOL

[75] Inventor: Erwin Bohler, Bettwiesen, Switzerland

[73] Assignee: Forkardt Spanntechnik AG, Switzerland

[21] Appl. No.: 08/921,173

[22] Filed: Aug. 29, 1997

[30] Foreign Application Priority Data

Apr. 13, 1997 [EP] European Pat. Off. ..... 97106055

[51] Int. Cl.[6] ..... B25B 1/24

[52] U.S. Cl. ..... 269/43; 269/26; 269/34; 269/240; 269/246; 269/251

[58] Field of Search ..... 269/26, 34, 25, 269/240, 246, 251, 43

[56] References Cited

U.S. PATENT DOCUMENTS 2,757,391 8/1956 Stottlemyer ..... 269/34
3,643,937 2/1972 Russ ..... 269/251
3,899,162 8/1975 Fischer .

FOREIGN PATENT DOCUMENTS 39 19 560 12/1989 Germany .
58-028444 2/1983 Japan .
730728 5/1955 United Kingdom .

*Primary Examiner*—Robert C. Watson
*Attorney, Agent, or Firm*—Olson & Hierl, Ltd.

[57] ABSTRACT

The clamping device has two jaws between which a workpiece to be machined is immobilized on the table of a machine tool. Each jaw is supported by a carriage, and the carriages are coupled so as to move in a mirror symmetric fashion with respect to a plane orthogonal to the path of the carriages and at rest relative to the device. This avoids adding up tolerances of the shape of the workpiece with tolerance in the position of the clamping device relative to the machining tools.

6 Claims, 1 Drawing Sheet

CLAMPING DEVICE FOR A MACHINE TOOL

BACKGROUND OF THE INVENTION

Field of the Invention

Clamping devices for machine tools are devices which can be mounted on the table of a machine tool in order to maintain one or several workpieces in a determined position for machining them. When machining several identical workpieces on an automatic or semi-automatic machine tool, the clamping device must maintain in a reproducible way a succession of several identical workpieces in exactly the same position relative to the machining tools. To this end, known clamping devices comprise two jaws which can often be provided with jaw shoes the shape of which is adapted to the pieces to be machined. When the jaws are tightened, these shoes maintain the workpieces in a precisely predetermined and reproducible position. As in ordinary vices, a threaded spindle is used to press a movable jaw against the workpiece, which itself rests against the other, stationary jaw of the device. Such clamping devices are for instance described in the document PCT/US95/11132. The asymmetric way in which their jaws move with respect to the machine tool can be detrimental when a high precision is required, because small defects on the surfaces of the workpiece gripped by the jaws can become superposed to permissible variations in the positioning of the clamping device itself, and thereby double the actual error in position of the workpiece relative to the machine tool. Further, when for instance a cylindrical workpiece is gripped at right angle to its axis on its cylindrical surface, the radial error due to the imprecisions of the machine tool and of the clamping means can add up if the workpiece is not always oriented in the same way during a series of successive clamping operations. The same problems occurs when, due to a previous machining operation, a series of workpieces which can be clamped in two symmetrical orientations have an eccentricity which is still within the allowances but the orientation of which relative to the clamping means cannot be controlled.

BRIEF SUMMARY OF THE INVENTION

The invention aims at producing a high precision clamping device which avoids the possibility of a full superposition of errors due to imperfections of the surfaces gripped by the clamping device with errors due to allowances in the position of the clamping device. To this end the jaws of the device according to the invention can be forced to move symmetrically with respect to a plane at rest relative to the machine tool, as recited in claim 1. In order to improve productivity, clamping devices are sometimes used with an additional, fixed middle jaw in order to simultaneously hold several, not necessarily identical, workpieces. If, in such a case, the outer jaws are forced to move with absolute symmetry existing allowances in the size of the workpiece may lead to undesirable constraints. Therefore, a preferred embodiment of the invention allows one to disable the enforced coupling of the movements of the outer jaws. Thereafter, operating them only commands their mutual distance but not their positions relative to the main body of the device.

BRIEF DESCRIPTION OF THE DRAWING

The invention will now be illustrated in more detail through the description of an embodiment and with the help of the drawing in which.

DESCRIPTION OF THE PREFERRED EMBODIMENT

Figure 1:
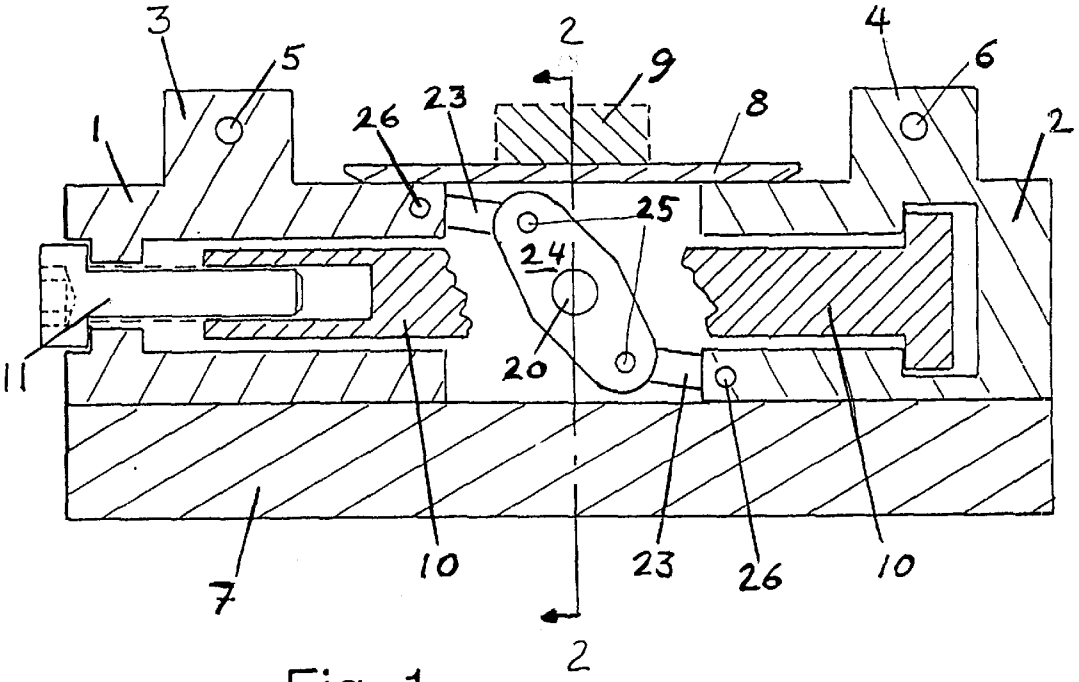
FIG. 1 schematically shows a partly broken section through an embodiment of the invention.

In FIG. 1 the numerals 1 and 2 identify the left and the right carriage for the left and the right jaw of the device, respectively. For a better overview, the drawing shows a much simplified construction where many essential parts well-known to one skilled in the art have been left out in order to better explain the working of the invention. As is known in the art, the carriages 1 and 2 are guided by the main body 7 of the device so that they can slide forth and back along a straight path. The main body itself is provided with means (not shown) by which it can be fixed in a determined position on the table of a machine tool (also not shown). Each carriage has a superstructure 3,4 on which can be mounted a shoe (not shown) adapted to the shape of the workpiece. The shoe can be fixed to the superstructure by bolts engaged in passages 5, 6 of the superstructures; in order to distribute the clamping forces, these passages are often shaped as obliquely elongated holes (not shown). A cover plate 8 supports the workpiece that is to be machined, and also protects the interior of the clamping device from dirt and metallic waste. The cover plate is maintained in place relative to the main body 7 of the clamping device by some usual means, such as positioning studs or the like (not shown). As described below, the cover plate 8 can support a third, middle superstructure 9 (drawn in broken lines) when one wishes to simultaneously maintain several workpieces in the clamping device in such a way that at least one workpiece is gripped between the left and the middle superstructure, and at least another one between the latter and the right superstructure.

Figure 2:
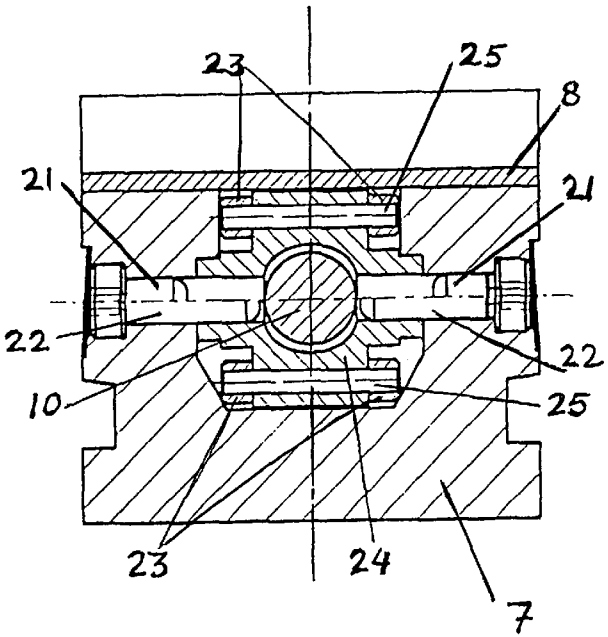
FIG. 2 shows a section along line II—II of FIG. 1.

A spindle 10 with an inner thread, and a screw 11 which engages in it are used in the well-known fashion for pressing the two carriages, and hence the two outer jaws, towards each other. In order to obtain a symmetrical movement of both carriages, there is provided a rocking lever 24, each end of which is linked through a rod 23 with one of the carriages 1, 2; to this end, the rocking lever is linked to a rod 23 by a bolt 25, and each rod is linked by another bolt 26 to the corresponding carriage. As shown in FIG. 2, the rocking lever 24 surrounds the spindle 10 at a distance which suffices to allow the rocking lever 24 to pivot by an angle which corresponds to the maximal stroke of the jaws. The swivelling of the rocking lever occurs around an axis formed by two cotter-pin bolts 22 introduced from either side into the main body 7 and engaged into a central bore hole 20 of the rocking lever. Obviously, the carriages 1 and 2 are forced to move with mirror symmetry relative to a plane which is normal to the axis of the spindle and contains the axis of both cotter-pin bolts 22. As remarked at the beginning, this makes for a greater precision, given the permissible variations of the workpieces to be machined and also of the compound unit formed by the machine tool with the clamping device mounted thereon.

Under certain conditions, especially when one utilises an immobile central superstructure 9 (drawn in broken lines), it may not be desirable to enforce strictly symmetrical displacements of the carriage relative to a transversal plane at rest with respect to the clamping device; such an enforcement may even result in a mechanical overdetermination, and the mechanical stresses which this implies. Given a fixed superstructure and with workpieces having the same rated dimensions on both sides of it, a constraint can for instance occur when the dimensions, measured in the direction of the spindle, of the workpieces placed on either side of the central jaw are equal only within certain allowances. In such a case, one can remove the cotter-pin bolts 22 and thereby free the rocking lever 24 so that it must not pivot around an axis fixed with respect to the main body 7. In order to protect the interior of the clamping device from dirt, the cotter-pin bolts 22 are then preferably replaced by shorter ones 21 which close the corresponding bore holes in the main body 7 without engaging the bore hole 20 of the rocking lever. Finally, note that the simple embodiment described here is only meant to illustrate the invention and that many variants can be imagined, for instance by enforcing a symmetrical movement of the carriages by hydraulic means instead of mechanical ones.

I claim:

1. A flat clamping device with two actuated jaw carriers for clamping at least one workpiece in order to machine it by a machine tool, the jaw carriers being coupled by coupling means which are independent of the means for generating the clamping force, where these coupling means force the jaw carriers to move in a mirror symmetric way with respect to a plane at rest relative to the main body of the clamping device, the coupling means being mechanical, characterized in that the coupling means comprise a rocking lever, and the pivoting axis of the rocking lever is formed by two aligned, removable cotter-pin bolts inserted from either side into the main body of the device.

2. Flat clamping device according to claim 1, characterized in that the coupling means can be disabled.

3. Flat clamping device according to claim 1, characterized in that the coupling means comprise a rocking lever which pivots around an axis transversal to the direction of the clamping force, each end of the rocking lever being connected with a corresponding jaw carrier movable in the direction of the clamping force.

4. Flat clamping device according to claim 3, characterized in that a connecting rod is connected between each end of the rocking lever and the corresponding jaw carrier, each connecting rod being linked by articulations with the rocking lever and with the jaw carrier.

5. A flat clamping device according to claim 1, characterized in that the clamping force is provided by a threaded spindle which traverses the rocking lever.

6. A flat clamping device with two actuated jaw carriers for clamping at least one workpiece in order to machine it by a machine tool, where the jaw carriers are coupled by coupling means which are independent of the means for generating the clamping force, where these means force the jaw carriers to move in a mirror symmetric way with respect to plane at rest relative to the main body of the clamping device, the coupling means comprising a rocking lever which pivots around an axis transverse to the direction of the clamping force, with each end of the rocking lever being connected with a corresponding jaw carrier movable in the direction of the clamping force, the clamping force being provided by a threaded spindle which traverses the rocking lever, the fulcrum of the rocking lever being formed by two aligned, removable cotter-pin bolts inserted from either side into the main body of the flat clamping device.

* * * * *